US005472123A

United States Patent [19]

Jangaard

[11] Patent Number: 5,472,123

[45] Date of Patent: Dec. 5, 1995

[54] FLAP VALVE FOR THE NECK OF A FLEXIBLE-WALLED BOTTLE

[76] Inventor: Stephen S. Jangaard, 5221 W. Carson St., Torrance, Calif. 90503

[21] Appl. No.: 289,464

[22] Filed: Aug. 12, 1994

[51] Int. Cl.[6] ..... B65D 37/00

[52] U.S. Cl. ..... 222/212; 222/494

[58] Field of Search ..... 222/212, 491, 222/541, 494

[56] References Cited

U.S. PATENT DOCUMENTS

| | | | |
|---|---|---|---|
| 2,482,384 | 9/1949 | Tullgren et al. . | |
| 2,657,829 | 11/1953 | Walch . | |
| 2,755,974 | 7/1956 | Godfrey . | |
| 3,081,006 | 3/1963 | Land . | |
| 3,726,436 | 4/1973 | Despain et al. . | |
| 4,842,152 | 6/1989 | Donegan . | |
| 4,938,390 | 7/1990 | Markva . | |
| 4,949,857 | 8/1990 | Russell . | |
| 4,953,706 | 9/1990 | Piccard . | |
| 5,044,531 | 9/1991 | Rhodes, Jr. | 222/541 X |
| 5,249,714 | 10/1993 | Merhar | 222/541 X |

FOREIGN PATENT DOCUMENTS

| | | | |
|---|---|---|---|
| 8806129 | 8/1988 | WIPO | 222/491 |

*Primary Examiner*—Gregory L. Huson
*Attorney, Agent, or Firm*—Poms, Smith, Lande & Rose

[57] ABSTRACT

A bottle having a valve system which prevents fluid which is stored in the bottle from flowing out of the neck until a user squeezes the base of the bottle as a molded plastic base with flexible walls and a fluid reservoir. A molded plastic neck portion may have a base opening adjacent to the fluid reservoir, a bottle opening through which the fluid may exit the bottle, and a channel connecting the base opening with the bottle opening. The neck portion may have an upper retaining lip and a lower retaining lip disposed within the neck portion. The neck portion may also have a retention groove in between the upper retaining lip and the lower retaining lip. A valve having a flexible flap with an edge and a blocking portion may be disposed within the neck. The valve may have a closed position in which the flap edge is releasably disposed within the retention groove and in which the blocking portion extends across and obstructs the channel to prevent the fluid from flowing through the channel. The valve may also have an open position in which the flap edge is disengaged from the retention groove and the channel is substantially unobstructed by the blocking portion. The flap may remain entirely within the bottle in the open position. The valve is initially closed in the closed position and remains in the closed position until the user squeezes the flexible walls.

25 Claims, 4 Drawing Sheets

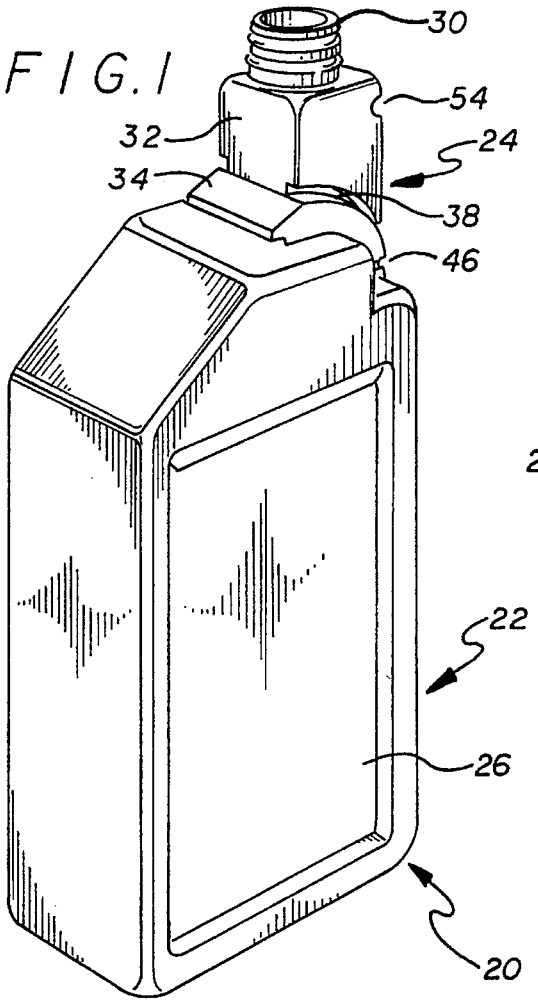
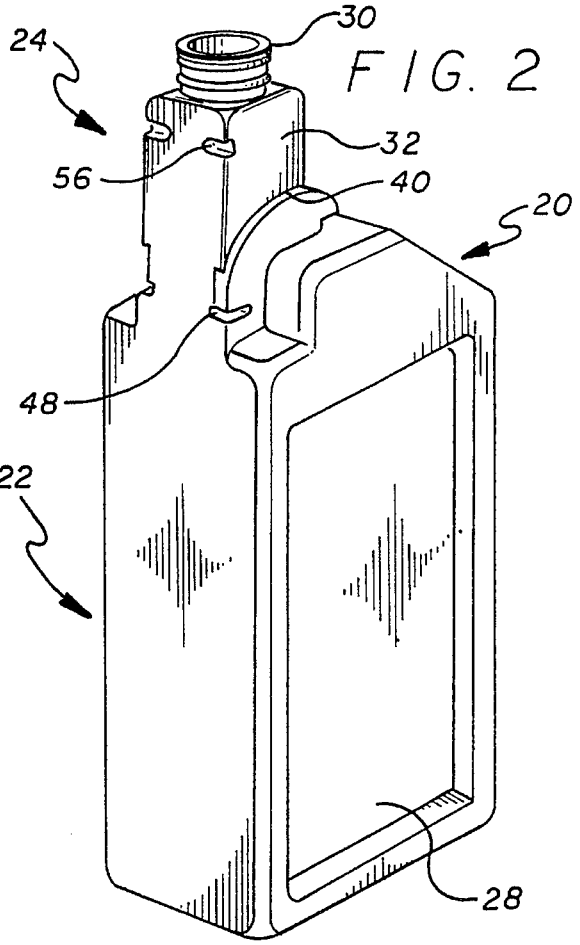
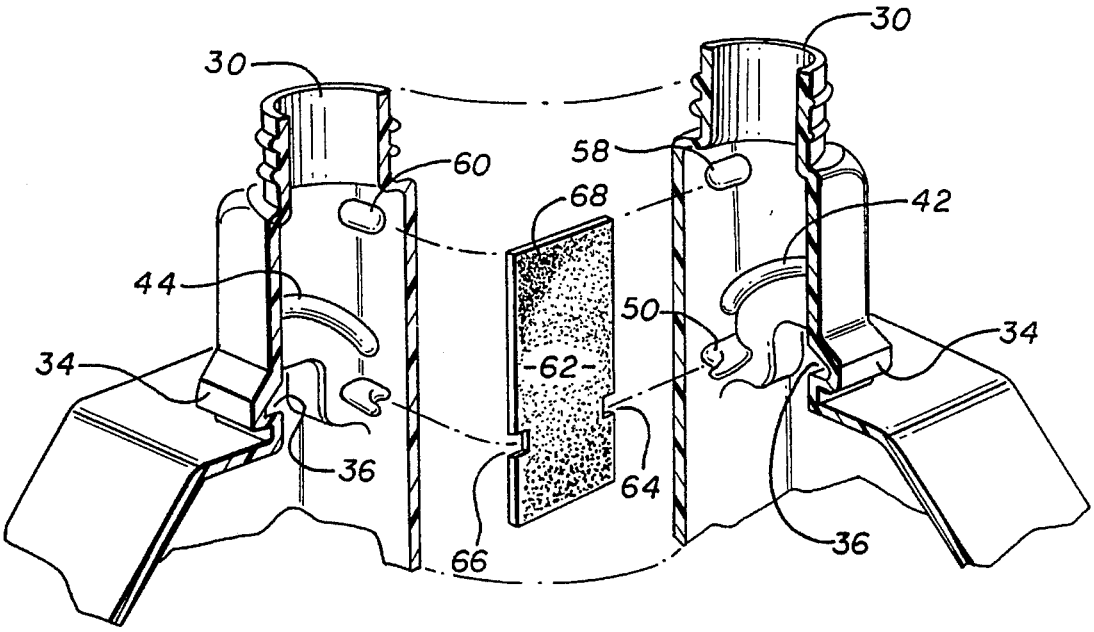
FIG. 3

FLAP VALVE FOR THE NECK OF A FLEXIBLE-WALLED BOTTLE

FIELD OF THE INVENTION

The present invention relates to valve systems for preventing flow of a fluid through the neck of a bottle, and specifically to a valve system having a flexible flap which blocks the flow of fluid through the neck of the bottle until the user squeezes the sides of the bottle.

BACKGROUND OF THE INVENTION

Millions of quarts of motor oil are sold every year in the United States and around the world. Motor oil is typically sold in molded plastic oil containers with a screw top mounted at the end of the neck. To pour the oil into the crankcase of an automobile, the user typically unscrews the top from the end of the neck and tips the bottle upside down. The user then quickly attempts to insert the neck of the bottle into the opening in the crankcase before the oil begins pouring out the neck of the bottle.

As many motorists know, there is a big problem with this approach. More often than not, the user is not able to position the neck of the bottle into the hole in the crankcase before the motor oil begins to pour out. Some of the oil inevitably flows on top of the crankcase rather than into the hole. The engine then becomes dirty and grimy, and must be steam cleaned in order to regain a clean appearance. Furthermore, the misplaced oil may become very hot and begin smoking, thereby creating an unpleasant odor and causing the driver to believe something may be wrong with the engine. Another problem is that motor oil is considered a hazardous waste and should not be allowed to flow onto the ground, as may occur when the misplaced oil drips onto the ground from off the engine.

Various schemes have been proposed to prevent oil from flowing out of the bottle until the user has aligned the neck of the bottle with the hole in the crankcase. However, none of these schemes meet two important criteria for a system which is both popular and practical to make. First, any motor oil bottle must allow the oil to flow quickly out of the bottle into the crankcase so that the user does not need to spend an inordinate amount of time waiting for the oil to flow out. Secondly, a motor oil bottle must be fairly inexpensive to make, as competition in the motor oil industry is tight and millions upon millions motor oil bottles must be manufactured. Additionally, the bottle itself should not have any parts which can fall out of the bottle and into the crankcase.

One proposal is suggested in Piccard U.S. Pat. No. 4,953,796. The Piccard patent discloses a container such as a motor oil container having a seal film covering the opening at the neck of the bottle. A mechanical system which has first and second elongated rod members which are pivotally jointed to one another, one of which having a cutter blade at the tip thereof, is contained within the bottle. When the user squeezes the bottle, the elongated arms pivot in such a way as to cause the cutter blade to perforate the closure film. Oil can then exit out of the bottle through the perforation.

One difficulty with this approach is that the cutter blade would merely make a hole in the closure film. Oil would exit the bottle quite slowly through the small hole made by the cutter blade, and consumers would likely become frustrated at the long wait necessary for oil to drain out of the bottle. An additional difficulty is that it appears that there is nothing to hold the elongated rods within the bottle once the closure film has been pierced. If the elongated rods were to fall into the crankcase, the engine could become severely damaged. Likewise, the closure film itself could come off from the opening of the neck of the bottle and fall down into the crankcase, again creating the possibility of serious engine damage. Another difficulty is that the mechanical components would be expensive to make and to insert into the bottle.

Another approach is disclosed in Markva U.S. Pat. No. 4,938,390 and Russell U.S. Pat. No. 4,949,857. Both of these patents disclose a bottle having a seal membrane secured on the exterior of the end of the neck to cover the outside of the neck opening. When the user squeezes the bottle of oil, the membrane may burst open at a critical pressure, such as illustrated in Markva FIGS. 2 and 2*a* and Russell FIG. 3. Alternatively, the membrane may pop-up off the end of the neck in certain portions as in Markva FIGS. 1, 4*a*, 5*a* and 6*a*.

All of these schemes have a seal mounted on the exterior of the bottle. Under the influence of the pressure generated when the user squeezes the bottle, the seal opens toward and could fall into the crankcase. The engine would then become damaged, and the manufacturer of the oil bottle could be liable for the damage to the engine. Another difficulty is that the seals tend to suddenly fail at a critical pressure, causing oil to spray out of the opening. A further problem is that in all of these arrangements, the membrane tends to continue to block a portion of the neck opening even after having ruptured, thereby interfering with the flow of oil. Also, once the seal has been broken, the oil pressure is released and there is no more pressure to break the seal further.

Despain et al. U.S. Pat. No. 3,726,436 proposes a self-resealing valve system for use in ketchup and mustard bottles and the like. The valve includes a plurality of overlapping flaps which open to form a central passageway when pressure is exerted from within the container. Elastic stiffeners return the flaps to their original location when pressure from within the container is released.

The Despain disclosure is directed to applications where the valve is intended to shut when the user has stopped squeezing the tube or bottle. For instance, the neck of a ketchup bottle may include such a valve unit. The valve would open when the user squeezes the bottle of ketchup, but then closes and prevent further flow of ketchup once the user stops squeezing the bottle. This arrangement would not be appropriate for use in a molded motor oil or transmission fluid bottle, where a continuous, uninterrupted flow out of the bottle is desired. That is, someone dispensing motor oil into a crankcase does not-want to have to continually squeeze the bottle to generate a flow of fluid out of the bottle.

From a manufacturing standpoint, the arrangement of Despain et al. would appear to be fairly expensive to manufacture within the context of a plastic motor oil or transmission fluid bottle. The elastic stiffeners would need to be either glued or otherwise adhered to the interior walls of the neck, or would need to be molded integrally with the neck. In either case, manufacture would be expensive. Furthermore, if the stiffeners were to be glued inside the neck, there would be the possibility that the glue could fail and a stiffener could fall into the crankcase. Additionally, the flaps of Despain et al. do not fully clear the opening even when open, thereby continuing to restrict the flow of oil somewhat even when the valve is in an open position. Thus, a bottle having such a valve system would tend to empty more slowly than a bottle which did not have the system.

Tullgren et al. U.S. Pat. No. 2,482,384, discloses a type of internal dust cover which prevents contaminants from reaching the oil supply inside a rubber oil can. The dust cover consists of a circular rubber member which is integral to a portion of the interior wall of the rubber neck of the oil can. It is apparent from the geometry of Tullgren et al. FIGS. 1–3, that the flap can open only a small amount when a user squeezes the base of the rubber oil can.

Since the Tullgren et al. disclosure is directed to a low flow oil can, it would not be appropriate for use in relatively higher volume flow containers such as motor oil, transmission fluid, and gasoline treatment containers. As discussed previously, it is not desirable in such containers to include a valve system which impedes the flow of fluid out of the container.

Since Tullgren et al. is directed to a specific purpose, it does not provide any means for retaining the flap in a closed position when the oil can is turned upside down. Once the user has turned the oil container upside down, the weight of the oil would immediately open the flap somewhat and oil would begin exiting out of the neck. If the user was not very quick, the oil would tend to pour onto other parts of the engine.

An additional difficulty with adapting the Tullgren et al. arrangement to a standard motor oil container is that it would be very difficult or impossible to blow mold the neck portion of the container. Also, the neck portion and the flap of Tullgren et al. are integral and are made of the same material. It would not be possible to make a somewhat rigid neck portion while, at the same time, having a flexible interior flap.

Various other valve systems have been devised for the necks of flexible containers, particularly for toothpaste tubes. Such systems are disclosed in Godfrey U.S. Pat. No. 2,755,974, Walch U.S. Pat. No. 2,657,829 and Land U.S. Pat. No. 3,081,006. These systems tend to be rather complex, would be rather expensive to manufacture, and block the opening once the user has stopped squeezing the tube.

It is therefore apparent that there is presently a need for a valve system which can be incorporated into the neck of a container for motor oil, transmission fluid, gas treatment and the like which will prevent flow of the fluid out of the bottle when the bottle is turned upside down until the user squeezes the flexible walls of the bottle. Once the user has squeezed the walls of the bottle, the valve system should open to allow rapid flow of the fluid out of the bottle without requiring the user to further squeeze the bottle. The valve system should be contained entirely within the bottle and the components of the valve system should be prevented from falling out of the bottle into the crankcase. Additionally, the valve system should be inexpensive to mass produce.

SUMMARY OF THE INVENTION

It is an object of the present invention to provide a valve system which can be incorporated into the neck of a container for a variety of fluids which will prevent flow of the fluid out of the bottle when the bottle is turned upside down. It is also an object of the present invention to provide such a valve system which will open when the user squeezes the flexible sides of the bottle. Another object of the present invention is to provide a valve system which will open to allow rapid flow of the fluid out of the bottle without requiring the user to further squeeze the bottle. It is a further object of the present invention to provide a valve system which is entirely contained within the bottle and in which the components of the valve system are prevented from falling out of the bottle. An additional object is to provide a system for increasing the flow rate of motor oil and similar fluids out of the neck of a bottle. Furthermore, it is an object of the present invention to provide a valve system which is inexpensive to mass produce.

A bottle which has a valve system which prevents fluid which is stored in the bottle from flowing out of the neck of the bottle until the user squeezes the base of the bottle, may have a base having a flexible wall and an interior cavity. A supply of fluid may be kept within the interior cavity. The bottle may have a neck portion which has a base opening adjacent to the cavity. The neck also has a bottle opening through which the fluid may leave the bottle. A channel connects the base opening with the bottle opening. A flap may be disposed within the neck of the bottle. The flap may have a closed position in which the flap extends across and obstructs the channel to prevent fluid from flowing out of the bottle. The flap may also have an open position in which the flap is substantially clear of the channel, allowing fluid to flow out of the bottle. The neck of the bottle may have a retaining lip on the interior wall which retains the free edge of the flap in the closed position until the user squeezes the flexible wall and causes the flap to move into the open position.

In accordance with another embodiment of the present invention, a bottle may have a base which has a flexible wall and a fluid reservoir. The bottle may also have a neck that has an opening in its base which communicates with the fluid reservoir. The neck may also have an opening through which the fluid may exit the bottle. A channel may connect the base opening with the bottle exit opening. A flap may be disposed within the neck. The flap may have a closed position in which the flap extends across an obstructs the channel. The flap may also have an open position in which the channel is substantially unobstructed. The bottle includes means for retaining the flap in the closed position until the user squeezes the flexible wall of the base. The bottle also includes means for preventing the flap from returning to the closed position once the flap is in the open position.

In accordance with an additional embodiment of the present invention, a bottle may have a valve system which prevents fluid which is stored in the bottle from flowing out of the neck of the bottle until the user squeezes the base of the bottle. The bottle may have a molded plastic base having flexible walls which has a fluid reservoir inside. The bottle may also have a molded plastic neck portion having a base opening adjacent to the fluid reservoir. The neck portion may also have a bottle opening through which the fluid may exit the bottle. A channel may connect the base opening with the bottle opening. The neck portion may have an upper retaining lip and a lower retaining lip disposed within the neck portion. The neck portion may further have a retaining groove which is in between the upper and lower retaining lips. A valve that has a flexible flap may be disposed within the neck. The flexible flap may have an edge and a blocking portion. The valve may have a closed portion in which the flap edge is releasably disposed within the retaining groove, and in which the blocking portion of the flap extends across and obstructs the channel. In this closed position, the fluid is prevented from flowing through the channel. The valve may also have an open position in which the flap edge is disengaged from the retaining groove. In this open position, the channel is substantially unobstructed by the blocking portion of the flap. The flap remains entirely within the bottle in the open position. The valve may be initially in the closed position and may remain in the closed position until the user squeezes the flexible walls. Fluid is thereby forced against the flap and causes the flap to disengage from the retention groove.

In accordance with various other aspects of the present invention, the upper lip may protrude inwardly into the neck from the interior neck wall. The upper lip may comprise a continuous lip extending across the wall, or may be several spaced protrusions. The neck portion may be integral to the base portion or may be separable therefrom. The neck portion may have at least one catch which extends inwardly into the interior of the neck. This catch may be disposed in between the edge of the flap and the upper retaining lip when the flap is in the open position. The flap edge is thereby prevented from reengaging with the retention groove. The neck portion of the bottle may also have a flap position limitter which protrudes inwardly from the interior wall of the neck portion. The position limiter may serve to maintain the flap edge a distance away from the interior wall when the flap is in the open position.

The bottle opening may have a certain bottle opening width, and the flap may have a certain flap width. The flap width may be greater than the bottle opening width. The flap is then prevented from leaving the bottle as the fluid flows out of the bottle. The neck may also have an interior width at the open position which is slightly narrower than the width of the flap at that position. The flap is then squeezed somewhat at the open position, creating a body line in the flap. This body line prevents the flap from bending back toward the closed position. Furthermore, the friction between the flap edges and the inner wall prevents the flap from rotating back toward the closed position.

The neck may also have one or more guide lips which extend inwardly from the interior wall of the neck. The guide lip may be disposed in between the flap edge and the bottle opening in both the open and closed positions. The retention lips of the present invention may be linear, or they may be curved. The upper and lower retention lips may extend around the interior wall of the neck portion, or they may extend around only a portion thereof.

In accordance with one particular embodiment, the bottle may have first and second upper lips. The flap may have first and second edges. The interior wall may have first and second retaining grooves, with the second flap edge being disposed within the second retaining groove. The second upper lip may extend inwardly from the inner neck wall a distance greater than the distance that the first upper lip extends inwardly from the inner neck wall. The flap will then pop up and over the first upper lip wall when the user squeezes the flexible walls of the bottle.

The flap may have a first and second edge. The bottle may have one or more retention prongs which extend inwardly into the bottle. A portion of the second flap edge may then be disposed within the retention prong or prongs in both the open and closed position. The flap may have hinge protrusions, and the interior walls of the neck may have hinge indentations. The flap may be hingedly mounted in the interior walls, with the hinge protrusions being disposed within the indentations. In accordance with various embodiments of the present invention, the neck may have a round outer neck portion, with outwardly protruding threads to accommodate a screw top. The neck may have a first neck portion that has a substantially rectangular cross-section, and the flap may also be substantially rectangular. A major portion of the flap may be disposed within the first neck portion in both the open and closed positions. Additionally, the neck may have a second neck portion which as a substantially circular cross-section. The second neck portion may be adjacent on one side to the first neck portion, with the second neck portion having the bottle opening. The flap may be wider than the inner diameter of the second neck portion. The neck may also have one or more upper side lips on side inner walls of the neck. The bottle may also have means for preventing the flap from returning to the closed position once the flap is in the open position.

Other objects, features and advantages of the invention will become apparent from a consideration of the following detailed description and the accompanying drawings.

BRIEF DESCRIPTION OF THE DRAWINGS

FIG. 1 is an exterior rear perspective view of a first embodiment of the present invention;

FIG. 2 is a front exterior perspective view of the embodiment of FIG. 1;

FIG. 3 is an exploded perspective view of the interior of the neck of the embodiment of FIG. 1;

DETAILED DESCRIPTION OF A PREFERRED EMBODIMENT

Figure 4:
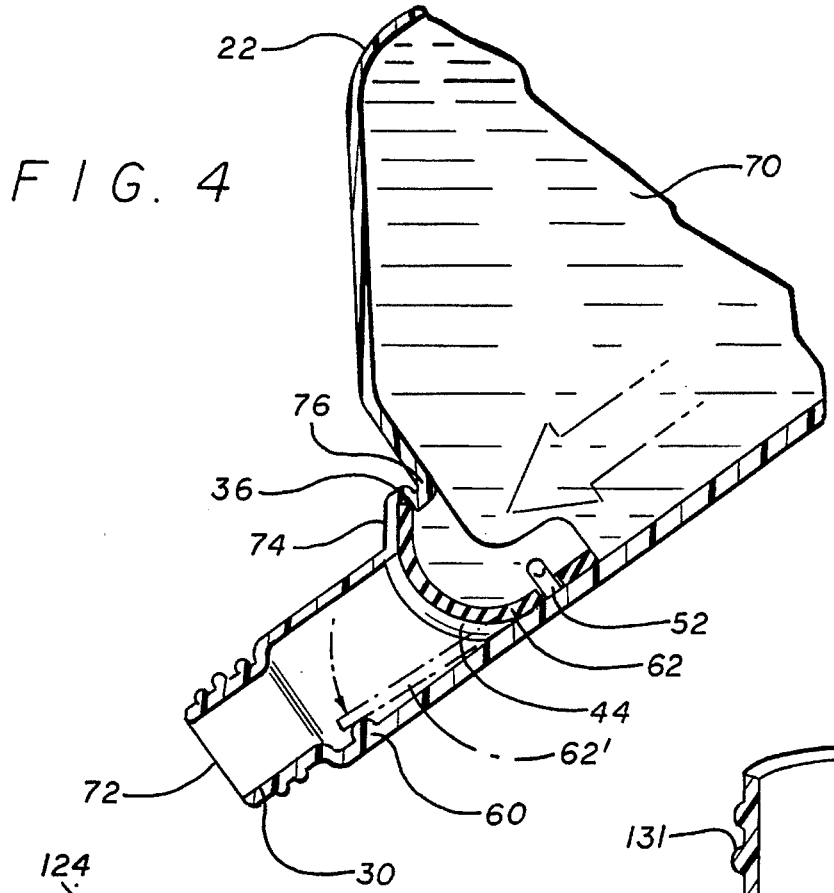
FIG. 4 is a sectional view along the neck of the bottle of FIG. 3 with the flap shown in solid lines in the closed position and the flap in phantom lines in the open position.

FIGS. 1–4 illustrate a first embodiment of the present invention. FIG. 1 shows a molded plastic oil container 20 having a base portion 22 and an integral neck portion 24. Base portion 22 has flexible walls 26 and 28 (FIG. 2). Neck portion 24 has a threaded spout portion 30 having a circular cross-section and an immediately adjacent portion 32 having a square cross-section. A common screw top may be screwed onto the threads of spout 30 when the bottle is not in use.

A portion of the exterior of the wall 34 protrudes outwardly to accommodate a free edge retention groove 36 (FIG. 3). Molded inwardly protruding portions 38, 40 correspond to inwardly protruding side retention lips 42, 44 (FIG. 3). Molded inwardly protruding portions 46, 48 correspond to inwardly protruding prongs 50, 52 (FIG. 3). Molded inwardly protruding indentations 54, 56 correspond to stops 58, 60. Oil container 20 is generally a thin-walled blow molded container with a hollow interior such that base portion 22 constitutes a fluid reservoir.

FIG. 3 illustrates a flexible rubber flap member 62 having inwardly extending apertures 64, 66 for mounting on prongs 50, 52, respectively. Flap 62 also includes a flap edge 68, which is also referred to as a free flap edge.

FIG. 4 illustrates the flap in a closed position, in which it retains a supply of oil 70 entirely within the bottle even when the bottle is turned upside down. FIG. 4 shows flap 62 in a closed position wherein the free edge 68 of flap 62 is engaged in retention groove 36. The side edges of the flap are retained by side lips 42 and 44. Flap 62 extends fully across the channel within the neck to block off flow of fluid through the neck. It should be noted that upper and lower retention groove walls 74 and 76 constitute upper and lower retention lips which retain the free edge 68 of flap 62 within the retention groove under the weight of the oil. However, when a user squeezes flexible walls 26, 28, oil is forced against the flap 62 and causes the free edge of the flap 68 to pop free from retention groove 36 and from side lips 42, 44. As the oil begins to flow through the channel of neck portion 24, flap 62 flaps open into an open position designated by the reference numeral 62'. In the open position, flap 62 does not substantially obstruct the channel in the neck, and oil is free to flow out of the bottle opening 72. Flap 62 is slightly wider than the width of the neck at the open position. Consequently, friction between the side edges of flap 62 and the side walls of the neck at the open position prevent the flap from returning to engagement with retention groove 36 once the flap is in the open position. Additionally, side lips 42, 44 also prevent the flexible flap from returning to the closed position from the open position.

Figure 5:
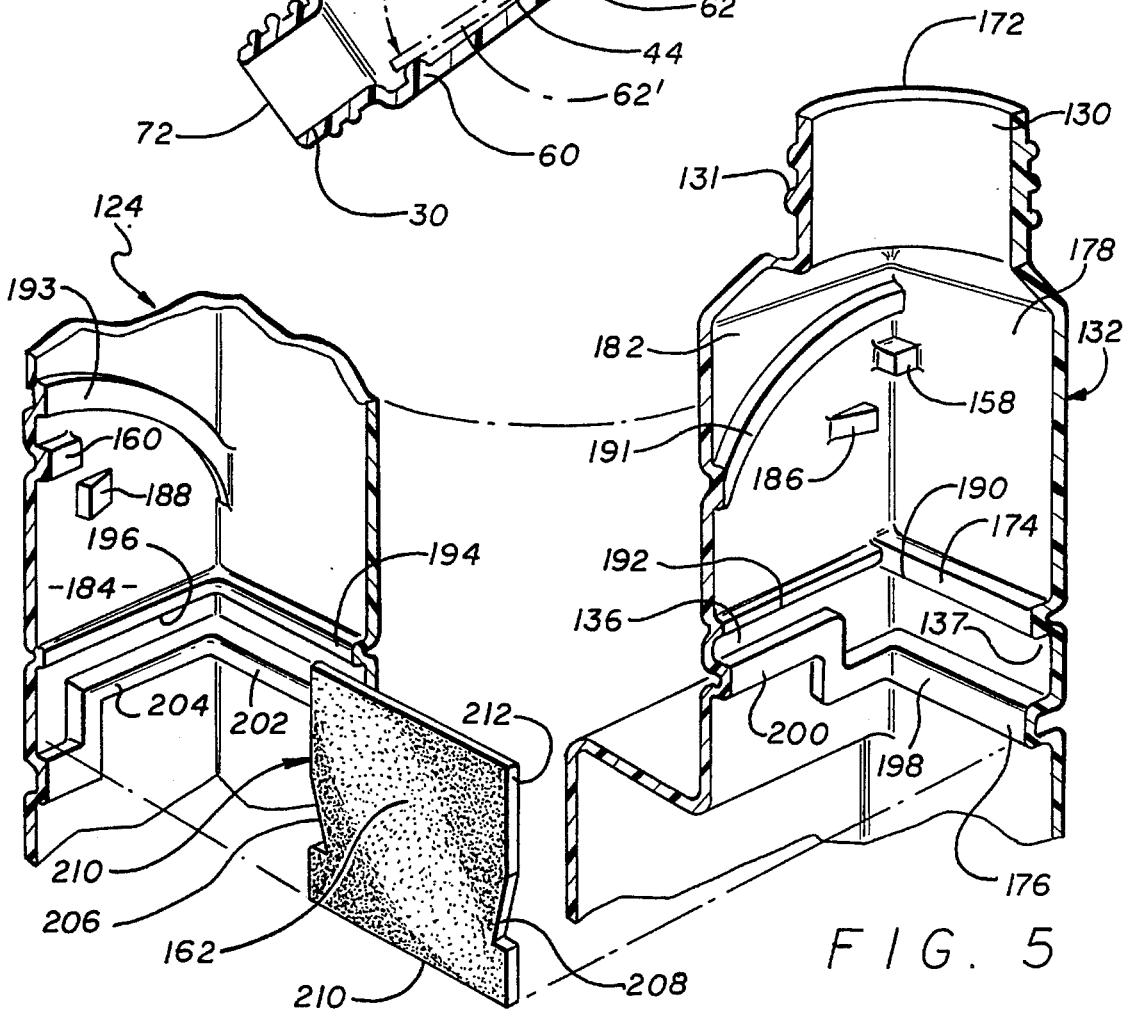
FIG. 5 is an exploded interior perspective view of the neck of a second embodiment of the present invention.
Figure 6:
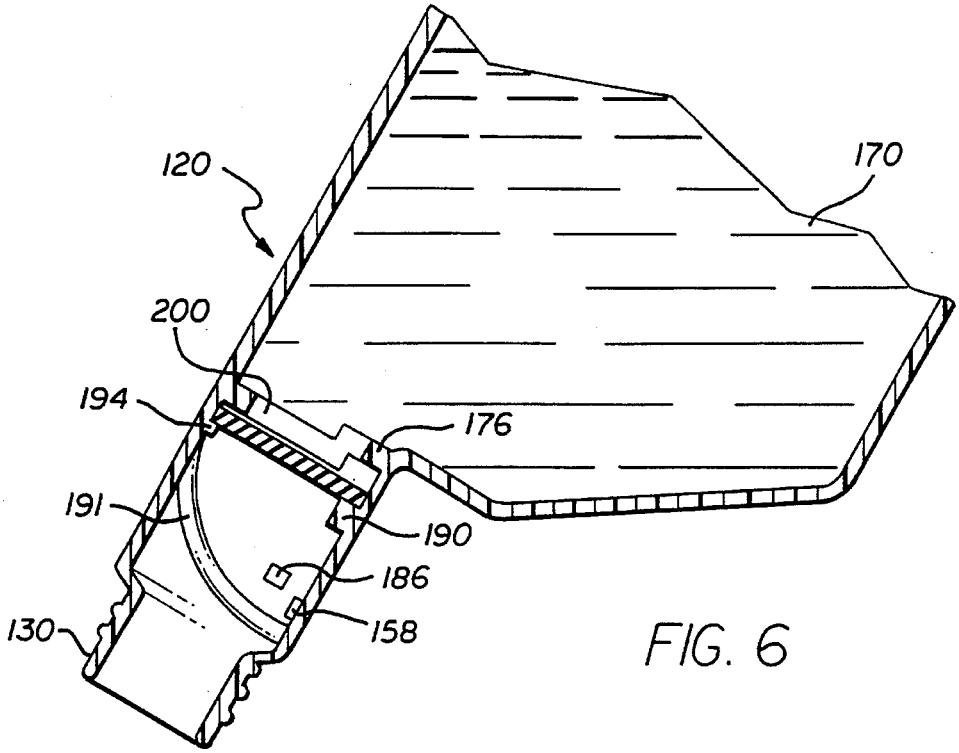
FIG. 6 is a sectional view taken along the neck of the bottle of FIG. 5 with the flap in the closed position.
Figure 7:
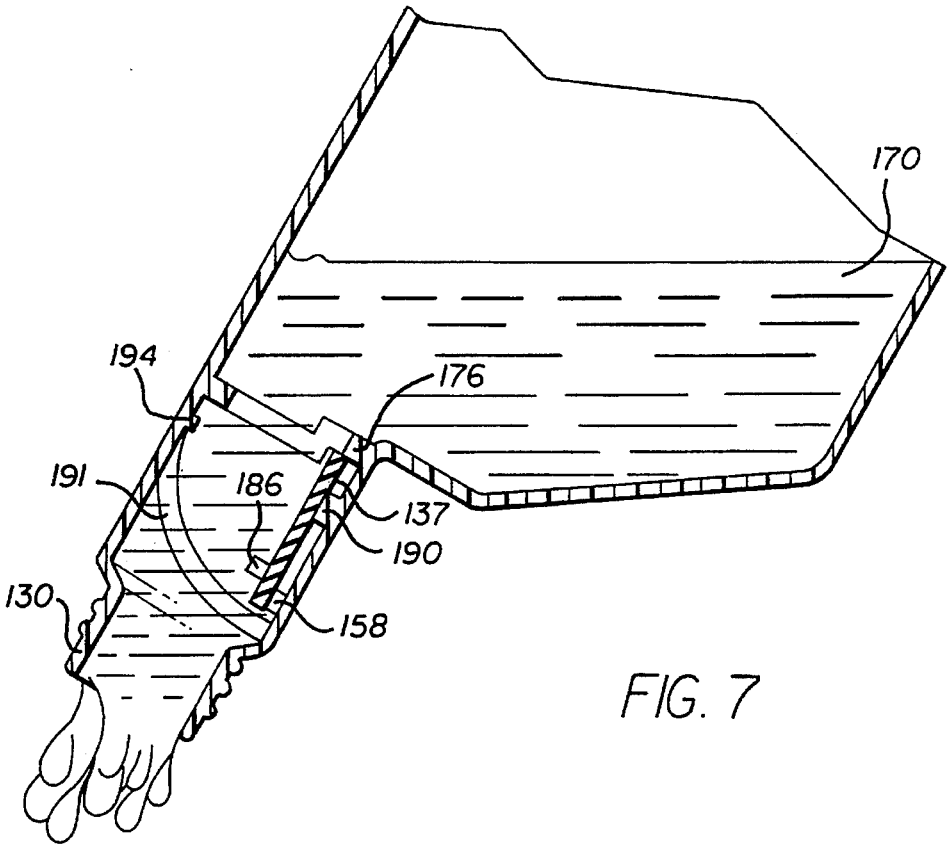
FIG. 7 is a sectional view along the neck of the embodiment of FIG. 5 with the flap in the open position.

FIGS. 5–7 illustrate a presently preferred embodiment of the invention. FIG. 5 is a partial exploded view, showing important portions of the neck 124. The interior of neck 124 includes a portion 132 which has a square cross-section. The portion of the neck 132 includes a front wall portion 178, a rear wall portion 180, and side wall portions 182 and 184. An upper retention lip 174 extends around and protrudes from the interior walls of neck portion 132. Similarly, a lower lip 176 also extends around the interior of the neck and protrudes from the interior walls thereof. The terms "upper" and "lower" are based on relative positions as considered when the bottle is right side up as sown in FIG. 5. Thus, the "upper" lip is actually below the "lower" lip when the bottle is turned upside down.

An important feature of this preferred embodiment is that upper lip 174 protrudes into the interior of the neck of the bottle a greater distance at certain points than at others. This determines which edge or edges of flap 162 will pop free of retention groove 136 when the user squeezes the flexible walls of the molded plastic oil container. As FIG. 5 illustrates, upper retention lip 174 protrudes inwardly into the neck of the bottle a greater distance along front wall 178 then it does along rear wall 180 and side walls 182, 184. Consequently, when the user squeezes the walls of the fluid reservoir in the base of the bottle, flap 162 will pop free of retention groove 136 along walls 180, 182 and 184, but not along wall 178.

FIG. 5 also illustrates flap stops 158, 160, also known as flap position limiters. Wedged catches 186, 188, also known as flap open position retainers, constitute means for retaining the flap in the open position. FIG. 5 also illustrates guide lips 191, 193, which prevent the flap 162 from moving too far up the neck in the open position. By limiting the upward extension of the flap, the back end of the flap is retained in the catch base, which is the wider part of the retention groove 137.

Retention groove 136 includes a portion along front wall 178 and immediately adjacent portions along side walls 182 and 184 in which the width of retention groove 136 is wider than the width of the retention groove elsewhere within the neck of the bottle. This portion of the groove is an open position well for the flap to slide down into in the open position.

FIG. 5 further illustrates that upper retention lip 174 has four separate segments. Segment 190 protrudes inwardly from front wall 178, while segments 192, 194 and 196 protrude inwardly from walls 182, 180 and 184, respectively. It can be seen that segment 190 protrudes inwardly a distance greater than segments 192, 194 and 196. Consequently, when the user squeezes the flexible walls of the bottle with fluid in the reservoir, free edge 168 will pop up and entirely over segment 196. Major portions of the two side edges of flap 162 will pop up and over side lip segments 192 and 194, respectively. However, the flap will not pop up over lip 174.

It is noted that lower retaining lip 176 includes a segment 198 on front wall 178, a segment 202 on rear wall 180, and Z-shaped segments 200 and 204 on side walls 182 and 184, respectively. In this particular embodiment, lower retaining lip segments 198, 200, 202 and 204 each protrude the same relative distance into the interior of the neck. Flap 162 includes angled side notches 206, 208 which engage with upper retention lip side segments 192 and 196, respectively, in the open position to help retain flap 162 in the open position.

FIG. 6 shows the embodiment of FIG. 5 having been overturned with the flap 162 in a closed position. In this closed position, the flap extends fully across the width of the channel in the neck and prevents fluid 170 from flowing from the fluid reservoir portion through the base opening of the neck. With flapper 162 in the closed position, a user may overturn a newly purchased quart of oil with the cap having been removed from upper neck portion 130, and the oil will still not flow out of the bottle. This gives the user sufficient time to insert neck portion 24 into the aperture of an automobile crankcase without oil spilling all over the engine, as is too often the case with existing motor oil containers. The upper lips may act as seals about the edge region of flapper 162 to prevent oil from seeping around the edges of the flapper and out the opening 172 of the container.

After the user has positioned neck 124 into the crankcase aperture, the user may then squeeze the flexible sides of the container to displace the oil within the fluid reservoir 170 toward the neck 124. Under the pressure of the displacing oil 170, the free edge 168 of flapper 162 pops free of upper lip 194. At the same time, or immediately thereafter, the side edges of flap 162 pop out of upper side retention lips 192 and 196. The flapper then quickly moves to the open position illustrated in FIG. 7. In this open position, lower edge 210 of flapper 162 drops down into the wide portion 137, also known as a catch base, of retention groove 136. Flap indentations 206, 208 engage about upper side retention lips 192, 196. The side edges 210, 212 of flap 162 rotate up and over catches 186, 188, and are thereby prevented from rotating back toward the closed position once flap 162 is in the open position. As seen in FIG. 7, the portion of flap 162 near free edge 168 cannot fully touch the interior wall of the neck because limiters 158, 160 prevent the flap from opening entirely. Instead, the limiters 158, 160 typically allow the outer surface of flap 162 to align with the inner edge of the outer neck portion 130.

The inventor of the present invention has determined that the flow rate of the oil out of bottle 120 may be substantially increased by incorporating flap limiters 158, 160 into the design of the neck. The precise dimensions of these limiters may be tuned to adjust the flow rate of oil out the bottle.

Figure 8:
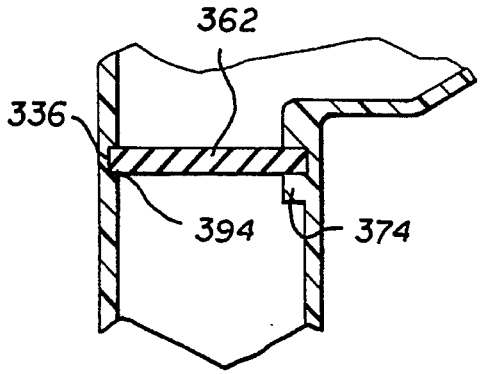
FIG. 8 illustrates an embodiment in which the retention groove extends outwardly into the neck wall and the upper and lower edges of the groove serve as upper and lower retention lips.

FIGS. 8–13 illustrate some of the embodiments of the present invention from a conceptual standpoint. FIG. 8 shows a flap 362 in a closed position in a retention groove 336, which projects into the wall of the neck. The upper and lower edges of retention groove 336 act as upper and lower retention lips. The width of upper retention lip 394 is less than the width of upper retention lip 374 so that the free edge of the flap will disengage from retention groove 336 when the user squeezes the flexible walls of the bottle to displace fluid through the neck. However, the opposite edge of the flap will not pop free of retention lip 374.

Figure 9:
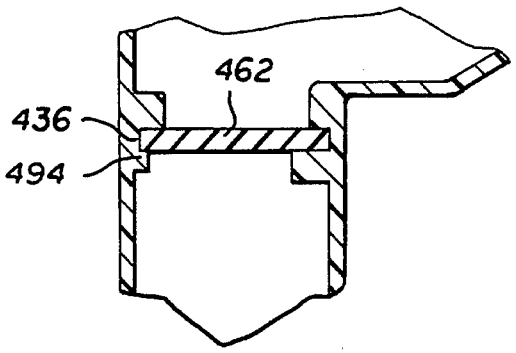
FIG. 9 illustrates an embodiment in which the free edge retention groove is defined by inwardly protruding upper and lower retention lips.

FIG. 9 shows a retaining groove 436 bounded on one side by an upper lip 494 and on the other side by a lower retaining lip. In this case, both the upper and lower retaining lips protrude inwardly into the neck of the bottle from the interior walls of the neck.

Figure 10:
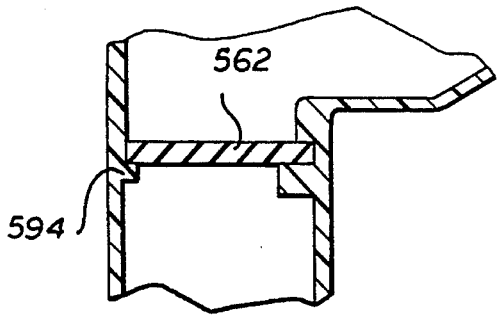
FIG. 10 illustrates an embodiment in which a single retention lip retains the free edge of the flap in the closed position.

FIG. 10 illustrates an embodiment in which the free edge of flap 562 is retained by a single retention lip 594 which protrudes inwardly into the interior of the neck from the interior wall of the neck. There is no lower lip to retain the free edge of the flap.

Figure 11:
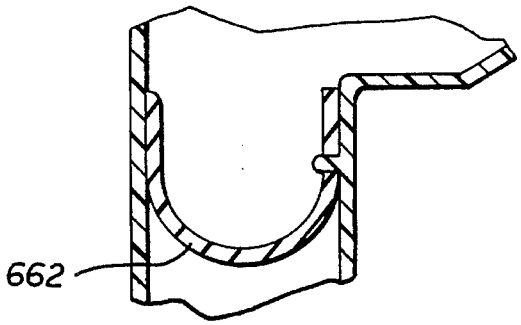
FIG. 11 illustrates an embodiment in which friction alone retains the free edge of the flap in the closed position.

FIG. 11 illustrates an embodiment in which the free edge of the flap 662 is retained in place by friction alone. There is no retention groove for the free edge, nor are there retention lips for that edge.

Figure 12:
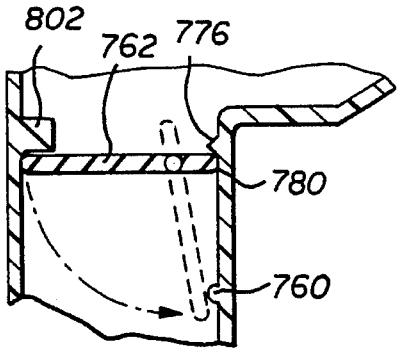
FIG. 12 illustrates an embodiment in which the flap is hingedly mounted within the neck of the bottle.
Figure 13:
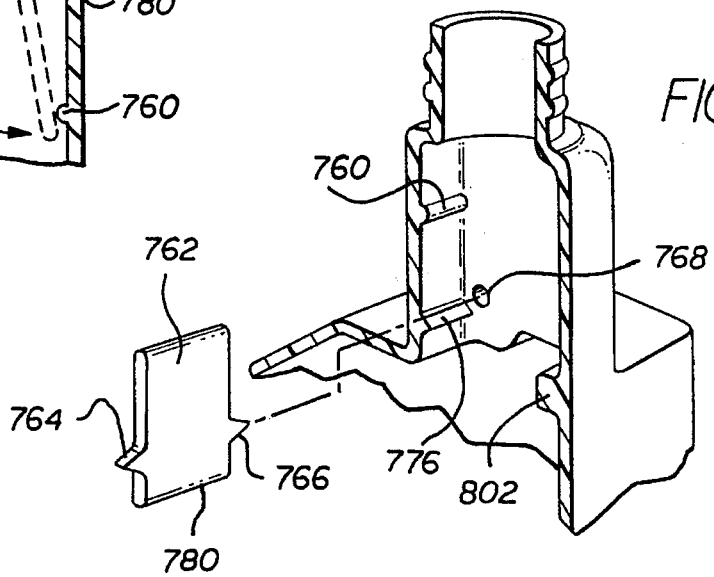
FIG. 13 illustrates a flap having hinge protrusions for use in the embodiment of FIG. 12.

FIGS. 12 and 13 illustrate an additional embodiment of the present invention. FIG. 12 shows a flap 762 which is hingedly mounted within the neck of the bottle. The neck of the bottle includes two lower retaining lips 776 and 802. When the oil can is overturned, protrusion 776 prevents rounded edge 780 of flap 762 from rotating toward the fluid reservoir. However, when the user squeezes the flexible walls of the container, rounded edge 780 is forced over protrusion 776 and flap 762 rotates into an open position, which is illustrated in broken lines. A limit stop or stops 760 prevent flap 762 from opening fully against the interior wall of the neck.

FIG. 13 is a partial exploded view showing how flap 762 of FIG. 12 mounts within the neck of FIG. 13. Flap 762 includes integral hinge pins 764 and 766, which are inserted into molded hinge pin indentations located on opposing sides of the neck. One such indentation is illustrated as Reference Numeral 768. It should be noted that the embodiment of FIGS. 12 and 13 may include additional retaining lips, such as side lips and upper retention lips, to further prevent flap 762 from rotating into the open position under the weight of the oil. Another variation is that lower lip 802 may be replaced with an upper lip.

As has been noted, the various embodiments include limit stops which prevent the flapper from fully opening when it is in the open position. An important function of the limit stops is to increase the rate of flow of the oil out of the bottle. The inventor has conducted an experiment utilizing an embodiment of the present invention such as that shown in FIGS. 1–4. In the particular prototype that the inventor used, certain exemplary dimensions are as follows. The inner diameter of the spout on the very upper portion of the oil container was approximately 0.87 inch. The plastic walls thereof were approximately 0.12 inch wide. The flapper was of the type shown in FIG. 3 in which the inwardly extending apertures on the sides of the flapper extended inwardly approximately 0.1 inch and extended approximately 0.16 inch along the length of the flap. The flap was approximately 1.18 inches wide and 0.05 inch thick. The distance from the midpoint of an inwardly extending aperture to the free edge of the flap was approximately 1.5 inches.

The square portion of the neck immediately adjacent to the circular cross-section spout had dimensions of 1.2 inches wide by 1.2 inches deep as taken from the exterior of the bottle. Flap retaining prongs were located approximately 1.6 inches down the square portion of the neck as measured from the juncture point between the upper circular cross-section portion of the neck and the square cross-section portion of the neck. The flap retaining groove was located approximately 0.62 inch above the prongs on the opposite wall. In the open position, the free edge of the flapper extended inwardly into the neck a distance of approximately 0.2 inch inward of the inner wall of the circular cross-section portion of the neck.

The experiment was conducted with 40 weight oil filling the fluid reservoir of the container. With no flap inserted in the bottle, the oil took approximately 18 seconds to completely flow out of the bottle once the bottle was overturned. With a flapper inserted into the neck in a model which had no limit stops, the time to evacuate the oil from the fluid reservoir in the fully open position was approximately 19 seconds. However, with a flap limit stop which protruded inwardly into the neck of the bottle a distance sufficient to cause the back surface of the free edge of the flap to extend to a point approximately 0.2 inch into the neck as measured from the inner wall of the upper circular cross-sectional portion of the neck, the fluid evacuation time was a mere 11 seconds. The same experiment was repeated with 30 weight oil and the respective evacuation times were found to be 16 seconds, 17 seconds, and 9 seconds, respectively. Consequently, the inventor has determined that the fluid evacuation rate increases significantly with a flap which is in a nearly open position as compared to an oil container of the same configuration which has either a flap that is completely open or no flap at all.

In conclusion, it is to be understood that the foregoing detailed description and the accompanying drawings relate to preferred embodiments of the invention. Various changes and modifications may be made without departing from the spirit and scope of the invention. Thus, by way of example and not of limitation, the flap may be made of any flexible material which will not degrade in the presence of oil or other petroleum-based products. The present invention is not limited to oil containers, but may be used for other containers such as those for transmission fluid, gasoline treatment, brake fluid, and a broad variety of other fluids. The present invention need not be an integral part of the container, but may be constructed within a unit that may be inserted into the neck of, or onto the neck of, a preexisting bottle. So, for instance, such a unit might comprise a hollow, molded plastic outer unit having retention grooves, retention lips, and/or a variety of other features contained within. The molded plastic outer unit may have screw threads on the base thereof to screw the unit onto screw threads already existing on the end of the neck of the bottle. Alternatively, such a unit may be inserted into the neck of a preexisting bottle and held in position by an adhesive or other means.

The bottles shown in the accompanying drawings typically have a rounded upper neck portion and a square or rectangular lower neck portion. However, the present invention is not limited to any particular geometry. Additionally, the flap need not be mounted within the neck of the bottle, but may be mounted further down into the bottle, so long as the flap extends across the fluid flow path in the closed position and prevents oil from flowing out of the bottle until the user squeezes the flexible walls of the bottle. So, for instance, the flap and the retention groove may actually be slightly below the neck of the bottle, with the free edge of the flap moving upward and into the neck when the user squeezes the side of the bottle.

It should also be noted that the bottle of the present invention need not be made of molded plastic, but may be made of any material which can contain oil and which has at least one flexible wall immediately adjacent to the fluid reservoir. The flap in the present invention is shown in the described embodiments as being a separate member from the molded plastic bottle body itself. While having a separate flap piece is preferable over having a flap piece which is integrally molded with or otherwise integral to any portion of the bottle, the present invention is not limited to embodiments in which the flapper is a separate unit from the rest of the bottle. Consequently, the flap may be a thin, flexible molded plastic extension extending from the inner wall of the neck inwardly to close off the fluid flow channel in the neck.

Various means for retaining the flap in the open position to prevent the flap from returning to the closed position have been illustrated herein. For instance, the flap may be slightly wider than the interior of the neck so that the flap is squeezed and a body line is formed. Friction further acts to hold the flap in the open position. Also, in some embodiments in which the flap is wider than the neck at the open position, the flap may have a tendency to twist such that the free edge aligns itself diagonally across the cross-section of the neck. That alignment further prevents the flap from returning to the closed position.

Furthermore, flap retention stops have been illustrated to show that the flap may be prevented by a physical barrier from returning to the closed position. A wide variety of different physical barriers can be employed to prevent the flap from returning to the closed position from the open position. For instance, the free edge of the flap may include extensions which engage in indentations which are molded into the neck of the bottle at the open position. The general idea is that once the flap is disengaged from the retention groove and/or retention protrusions, that there is a "catastrophic" failure of the valve in that the user does not need to take additional action to maintain the flow of oil out of the neck of the bottle or to prevent the flap from returning to a closed position.

The retention grooves illustrated herein are generally shown to be a single groove running for some distance in a continuous fashion about at least a portion of the interior wall of the neck. However, the retention groove could actually be comprised of a series of indentations in the wall of the neck. The free edge of the flap may have protrusions which engage with the indentations to maintain the flap in the closed position. When the user squeezes the sides of the bottle, the protrusions are forced out of the indentations and the flap swings to an open position. Likewise, the retention lips do not necessarily need to be continuous protrusions, but may be a series of protruding fingers or other members which extend into the neck of the bottle from the interior walls of the neck.

Furthermore, it should be noted that the position of the flap within the neck is generally not critical. So, for instance, the flap may be typically located at the base of the neck or at the mid-part of the neck, so long as the flap is not too long to move into the open position. As mentioned earlier, the shape of the flap should be such that it completely blocks the flow of fluid through the neck in the closed position. Various shapes may be employed in particular embodiments, such as round or rounded flaps, triangular flaps, and so on.

The various embodiment presented herein have included means for retaining the flap entirely within the bottle as the oil is pouring out the neck. For instance, in some embodiments, the flap is wider than the bottle opening through which the oil exits. In other embodiments, guide lips act as physical barriers to prevent the sides of the flap from moving upward within the neck beyond a certain distance. Additionally, the lower end of the flap may be physically attached to the wall of the neck of the bottle or, if the lower edge of the flap extends down into the base portion of the bottle, it may be otherwise attached there.

The square cross-sectional portion of the neck, such as 132 in FIG. 5, does not need to have sharp corners as shown. Those corners may be rounded both on the interior and exterior of the neck. The corresponding flap may also have rounded corners to conform with the inner contour of that portion of the neck. In regard to another aspect of the neck, the neck may be made to be separable from the body of the bottle in particular applications. However, the embodiments illustrated in the drawings all show neck portions which are integral to the body. One additional aspect of the neck is that many embodiments of the present invention will be intended to allow fluid to flow out of the fluid reservoir at a fairly high rate. Thus, as one example, one quart oil containers should generally empty within about 30 seconds, with a preferred emptying time of approximately less than 20 seconds. Consequently, the cross-sectional area of the neck at all points should be sufficient to allow the appropriate minimum flow rate out of the neck of the bottle for the particular fluid stored in the bottle.

FIGS. 8–13 are shown to illustrate various ways of holding the free edge in the closed position. However, these drawings are not intended as design drawings for production. Various lips are shown to protrude inwardly into the neck to a somewhat exaggerated extend for purposes of illustration.

The lower edge of the flap can be retained in many different way, including hinges such as 764, 766 in FIG. 13, prongs as shown on FIGS. 3 and 11, hinge pins which may be implanted into the flap, and a variety of other ways. An additional arrangement is shown in FIG. 5, in which the wide retention channel portion allows the lower edge of the flap to drop down in the open position. The particular means of retaining the lower edge of the flap in FIGS. 8–13 are generally interchangeable.

The drawings illustrate means for preventing seeping of the fluid, which can be oil, water, or any of a number of fluids, along the edges of the flap in the closed position. Such means include the various upper and lower lips which-may act as seals about the edges of the flap. Other sealing means will be apparent to those skilled in the art.

The general concept of increasing the flow rate of the fluid out of the bottle by utilizing flap position limiters, such as 58 and 60 in FIG. 3, is a general principle that is not limited to any particular valve system. Indeed, the present invention may be sold with the flap already in the open position with the purpose of providing the consumer with a bottle having an increased rate of fluid flow out of the bottle as compared to conventional bottles.

As for materials, the inventor has successfully used blow molded polyethylene for the bottle. However, a variety of other commonly known plastics may be used. The flap is generally made of neoprene rubber having a shore hardness of 35 to 45. An alternative flap material is EPDM which has a shore hardness of 55 to 65. The polyethylene is available from the DuPont Corporation, and the neoprene and EPDM are available from the McMaster-Carr Supply Company in Santa Fe Springs, Calif. A wide variety of flexible materials may be used for the flapper, including stiffer materials which may be used in embodiments such as that shown in FIG. 12.

Additionally, the present invention may be extended to a large variety of applications, such as water cooler bottles and other applications where a fluid container must be overturned and the fluid temporarily prevented from flowing out a neck.

Accordingly, the present invention is not limited to the specific embodiments shown in the drawings and described in the detailed description.

What is claimed is:

1. A bottle having a valve system which prevents fluid which is stored in the bottle from flowing out of the neck of the bottle until a user squeezes the base of the bottle, the bottle comprising:

a molded plastic base having flexible walls, said base comprising a-fluid reservoir;

a molded plastic neck portion having a base opening adjacent to said fluid reservoir, a bottle opening through which the fluid may exit the bottle, and a channel connecting said base opening with said bottle opening, said neck portion having an interior wall;

said neck portion having an upper retaining lip and a lower retaining lip, said upper and lower retaining lips being disposed within said neck portion, said neck portion further having a retention groove in between said upper retaining lip and said lower retaining lip;

a valve disposed within said neck, said valve comprising a flexible flap having an edge and a blocking portion;

said valve having a closed position in which said flap edge is releasably disposed within said retention groove and said blocking portion extends across and obstructs said channel to prevent the fluid from flowing through said channel; and said valve having an open position in which said flap edge is disengaged from said retention groove and said channel is substantially unobstructed by said blocking portion, said flap remaining entirely within the bottle in said open position;

wherein said valve is initially in said closed position and remains in said closed position until a user squeezes said flexible walls, thereby forcing the fluid against said flap and causing said flap to disengage from said retention groove.

2. A bottle having a valve system as defined in claim 1, wherein said upper lip protrudes inwardly into said neck from said interior neck wall.

3. A bottle having a valve system as defined in claim 2, wherein said upper lip comprises a plurality of protrusions.

4. A bottle having a valve system as defined in claim 1, wherein said bottle further comprises a supply of fluid disposed within said fluid reservoir.

5. A bottle having a valve system as defined in claim 1, wherein said neck portion is integral to said base.

6. A bottle having a-valve system as defined in claim 1, wherein said neck portion further comprises at least one catch extending inwardly from said interior wall, in which said catch is disposed in between said flap edge and said upper retaining lip when said flap is in said open position, thereby preventing said flap edge from engaging with said retention groove.

7. A bottle having a valve system as defined in claim 1, wherein said neck portion further comprises a flap position limiter protruding inwardly from said interior wall of said neck portion, said position limiter maintaining said flap edge a distance away from said interior wall in said open position.

8. A bottle having a valve system as defined in claim 1, wherein said bottle opening has a bottle opening width and said flap has a flap width, said flap width being greater than said bottle opening width, whereby said flap is fully retained within said bottle.

9. A bottle having a valve system as defined in claim 1, wherein said neck has an open position width and said flap has a flap width, said neck open position width being slightly narrower than said flap width.

10. A bottle having a valve system as defined in claim 1, wherein said neck further comprises a guide lip extending inwardly from said interior wall of said neck, wherein said guide lip is disposed in between said flap edge and said bottle opening in both said open and said closed positions.

11. A bottle having a valve system as defined in claim 1, wherein said retention lips are curved.

12. A bottle having a valve system as defined in claim 1, wherein said upper and lower lips extend around the interior wall of said neck.

13. A bottle having a valve system as defined in claim 1, wherein:

said upper lip is a first upper lip;

said flap further comprises a second edge;

said interior wall further comprises a second upper lip and a second retention groove, said second flap edge being disposed within said second retention groove; and said second upper lip extends inwardly from said inner neck wall a distance greater than the distance that said first upper lip extends inwardly from said inner neck wall.

14. A bottle having a valve system as defined in claim 1, wherein:

said flap further comprises a second edge;

said bottle further comprises a retention prong extending inwardly into said bottle; and a portion of said second flap edge is disposed within said retention prong in both said open position and in said closed position.

15. A bottle having a valve system as defined in claim 1, wherein said flap is substantially made of rubber.

16. A bottle having a valve system as defined in claim 1, wherein said flap comprises hinge protrusions, said interior walls of said neck have hinge indentations, and said flap is hingedly mounted in said interior walls, said hinge protrusions being disposed within said indentations.

17. A bottle having a valve system as defined in claim 1, wherein said neck further comprises a substantially round outer neck portion, said outer neck portion comprising outwardly protruding threads to accommodate a screw top.

18. A bottle having a valve system as defined in claim 1, wherein said neck further comprises a first neck portion having a substantially rectangular cross-section and said flap is substantially rectangular, a major portion of said flap being disposed within said first neck portion in both said open position and said closed position.

19. A bottle having a valve system as defined in claim 18, wherein said neck further comprises a second neck portion having a substantially circular cross-section, said second neck portion being adjacent on one side to said first neck portion, said neck portion having said bottle opening, said flap being wider than said second neck portion.

20. A bottle having a valve system as defined in claim 1, wherein said neck further comprises at least one upper side lip.

21. A bottle having a valve system as defined in claim 1, wherein said bottle further comprises means for preventing said flap from returning to said closed position once said flap is in said open position.

22. A bottle having a valve system which prevents fluid which is stored in the bottle from flowing out of the neck of the bottle until a user squeezes the base of the bottle, the bottle comprising:

a base having flexible walls and an interior cavity;

a neck portion having a base opening which is in communication with said cavity, a bottle opening through which fluid may exit the bottle, and a channel connecting said base opening with said bottle opening, said neck portion having an interior wall;

said neck portion having a retaining lip which is disposed within said neck portion;

a flexible flap disposed within said neck, said flap having a free edge;

said flap having a closed position in which said free edge is disposed inbetween said retaining lip and said base opening, and said flap extends across and obstructs said channel; and said flap having an open position in which said free edge is disposed inbetween said retaining lip and said bottle opening, and said flap is substantially clear of said channel.

23. A bottle having a valve system which prevents fluid which is stored in the bottle from flowing out of the neck of the bottle until a user squeezes the base of the bottle, the bottle comprising:

a base having a flexible wall and a fluid reservoir;

a neck portion having a base opening which is in communication with said fluid reservoir, a bottle opening through which fluid may exit the bottle, and a channel connecting said base opening with said bottle opening, said neck portion having an interior wall;

a flap, at least a portion of which is disposed within said neck, said flap having a free edge;

said flap having a closed position in which said flap extends across and obstructs said channel;

said flap having an open position in which said channel is substantially unobstructed;

means for retaining said flap in said closed position until a user squeezes said flexible wall of said base; and means for preventing said flap from returning to said closed position once said flap is in said open position;

wherein said flap remains substantially intact when put into said open position from said closed position, whereby said flap opens without rupturing.

24. A bottle having a valve system as defined in claim 23, wherein said bottle further comprises means for preventing oil from seeping about at least one edge of said flap in said closed position.

25. A bottle having a valve system which prevents fluid which is stored in the bottle from flowing out of the neck of the bottle until a user squeezes the base of the bottle, the bottle comprising:

a base having a flexible wall and an interior cavity;

a supply of fluid disposed within said interior cavity;

a neck portion having a base opening which is in communication with said cavity, a bottle opening through which said fluid may exit the bottle, and a channel connecting said base opening with said bottle opening, said neck portion having an interior wall;

a flap disposed within said neck, said flap having a free edge, said flap being mounted within the bottle;

said flap having a closed position in which said flap extends across and obstructs said channel;

said flap having an open position in which said flap is substantially clear of said channel; and a retaining lip disposed on said interior wall, wherein said retaining lip retains said free edge of said flap in said closed position until a user squeezes said flexible wall;

wherein said flap remains substantially intact when put into said open position from said closed position.

* * * * *